United States Patent [19]

Fuchs et al.

[11] 4,197,422

[45] Apr. 8, 1980

[54] COOLED COVER FOR AN ARC FURNACE

[75] Inventors: Gerhard Fuchs, Willstätt-Legelshurst; Rudolf Kasper, Baden-Baden, both of Fed. Rep. of Germany

[73] Assignee: Korf-Stahl AG, Baden-Baden, Fed. Rep. of Germany

[21] Appl. No.: 878,866

[22] Filed: Feb. 17, 1978

[30] Foreign Application Priority Data

Feb. 21, 1977 [DE] Fed. Rep. of Germany ..... 2707441

[51] Int. Cl.[2] ..... F27D 1/12

[52] U.S. Cl. ..... 13/32; 432/238

[58] Field of Search ..... 13/32, 35; 432/238

[56] References Cited

U.S. PATENT DOCUMENTS

| | | | |
|---|---|---|---|
| 2,222,004 | 11/1940 | Smith | 13/32 X |
| 2,766,736 | 10/1956 | Del-Buono | 13/32 X |
| 3,967,048 | 6/1976 | Longenecker | 13/32 X |
| 4,107,449 | 8/1978 | Sosonkin et al. | 13/35 |

*Primary Examiner*—Roy N. Envall, Jr.

[57] ABSTRACT

A cover for an arc furnace having a plurality of electrodes extending through a central area of the cover, a first cooling box surrounding the electrodes and a second cooling box in the outer area surrounding the central area of the cover. The first cooling box is subdivided into a plurality of cooling areas respectively associated with the plurality of electrodes, the cooling areas being electrically insulated from each other and from the second cooling box.

8 Claims, 4 Drawing Figures

8
9
9
8
4
5
3
16
6
3
20
7
3
1
2

36
34
35
33
37
29
49
39
38
41
18
40
32
22
42
15

COOLED COVER FOR AN ARC FURNACE

The invention relates to a liquid-cooled cover for an arc furnace.

It is known that the roof or cover of an arc furnace, which includes the openings and fittings necessary for operation thereof, for example for receiving electrodes which extend into the furnace interior, for introducing charging material and for removing waste gases and dust, is usually exposed to extreme thermal loadings. In order to be able to withstand such loadings, the furnace cover is usually in the form of an arch roof and is constructed from or lined with refractory bricks. A narrow ring of steel is usually provided, to carry the arch roof pressure. This ring is generally subjected to a lower thermal loading but frequently it is water-cooled.

As brick-built or brick-lined covers are very expensive to produce, because of the high cost of labor and material in making the covers, and as each repair or re-lining operation requires operation of the arc furnace to be stopped, attempts have been made to increase the durability of the lining by suitable choice of bricks or refractory material, and by providing cooling thereof. For example, in a water-cooled cover for an arc furnace, as previously proposed in the journal "Neue Hütte", 9th annual edition, issue No. 2, pages 118 and 119, the conventional lining with silica bricks is replaced by a water-cooled lining of basic stamped material, thereby seeking to provide a substantial increase in the cover durability. In the water-cooled arc furnace cover proposed in British Pat. No. 898,532, instead of bricks, the cover is a castable refractory material of aluminium oxide, which approximately corresponds to the thickness of the bricks and which is cooled from above by cooling tubes supplied with a cooling liquid. So that large pieces of refractory material cannot fall into the molten metal in the furnace, in the event of a rupture or crack in the refractory material, the cooling tubes are provided with studs or pins which are directed downwardly at an angle and which partly engage into each other, so that any pieces of refractory material which fall off are retained by the studs.

Finally, German patent application No. P 25 46 142.1–24 proposes a cover for an electric furnace; this cover is substantially in the form of a water cooling box which is protected, at its face which is towards the interior of the furnace, by a thin protective layer of refractory material.

In a liquid-cooled cover in which metal cooling boxes or metal tubes for carrying the cooling liquid extend over a large part of the area of the cover, there is a new problem which does not occur in brick-lined covers or even in covers which are only cooled in certain regions thereof, namely the danger of arcs of high current strength flashing over between the electrodes and the cover.

Uncontrollable arc flashing-over can be caused for example by the over-voltages which occur when there are interruptions in the operating arc. Such flashing-over phenomena are extremely dangerous, as the displacements in potential which they produce represent a direct danger to the safety and even the lives of the operating personnel. Indirectly, the high currents can damage the fittings and the cover itself, to such a severe extent that it becomes impossible to operate the furnace. Thus, the flow of coolant to the cover may be interrupted, and this can result in rapid destruction of the cover. If coolant should penetrate into the furnace, because of such damage to the cover, then this may result in an explosion.

According to the invention, there is provided a cover for an arc furnace, comprising at least openings for receiving electrodes, and, in the region surrounding said electrode openings and/or in at least a marginal portion, at least two cooling groups or portions for carrying a coolant, said groups or portions being electrically insulated from each other and being so constructed and arranged that any possible fault or leakage current path includes at least two electrically insulating positions.

The invention will now be described by way of example with reference to the accompanying drawings in which.

Figure 1:
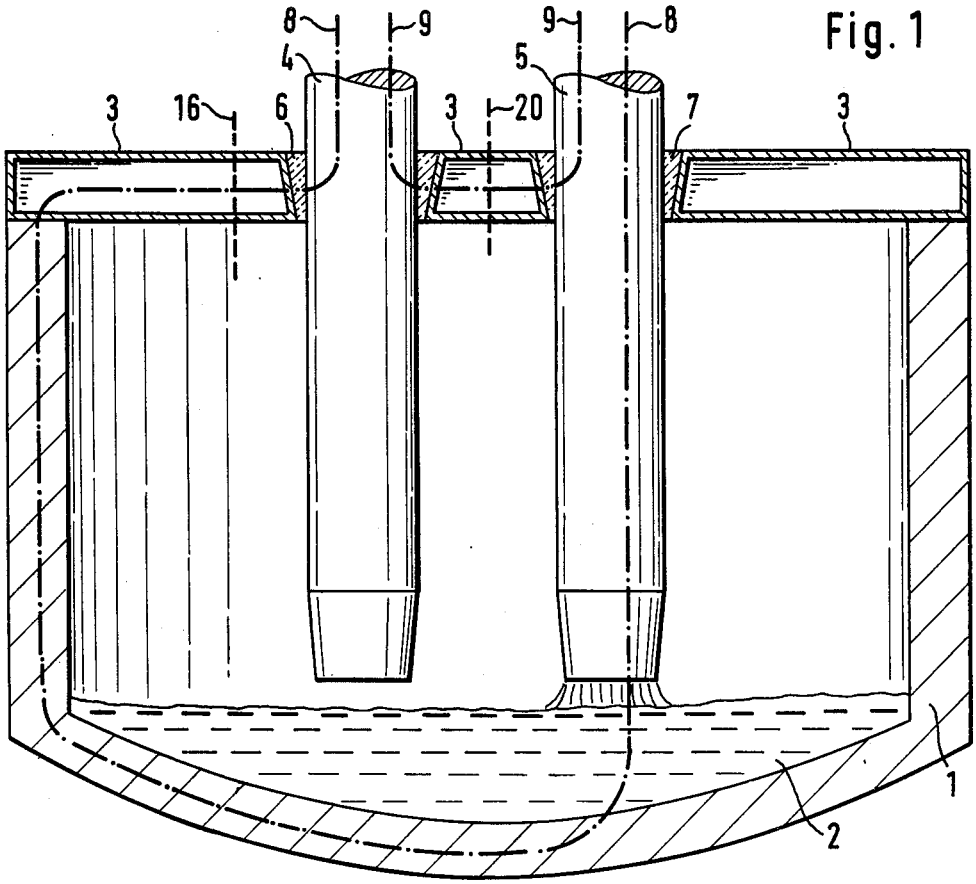
FIG. 1 shows a diagrammatic view of an electric arc furnace with three electrodes.

Reference is first made to FIG. 1 which shows fault or leakage current paths which in principle are possible, in an arc furnace whose cover is in the form of a metal box-like structure forming a cooling arrangement. In FIG. 1, reference numeral 1 denotes a furnace vessel, reference numeral 2 denotes a molten metal bath in the vessel 1, reference numeral 3 denotes a metal cooling box-like structure, herein called a cooling box, carrying a coolant, reference numerals 4 and 5 each denote a respective one of three electrodes (the third electrode is not shown in FIG. 1), and references 6 and 7 each denote a respective electrically insulating ring of refractory material. In theory, fault or leakage current paths 8 and 9 may be formed between two electrodes as represented in FIG. 1 by the two electrodes 4 and 5, such fault currents being triggered for example by the over-voltages which occur when the operating arc is interrupted. Arc flashing-over between the electrodes and the cover then results in the flow of a high-strength current, if an insulating section in the path 8 or 9 has ceased to be insulating and has become electrically conductive, because of a defect. This can occur for example due to material diffusion in the insulating material or because material falls onto the cover, for example conductive dust, furnace-charging material, and the like. In the construction shown in FIG. 1, if it is assumed that the wall of the furnace vessel 1 is electrically conductive, whether due to the support structure or due to material diffusion in the furnace lining, then it will be seen that the current path 8 comprises only one insulating position formed by the insulating ring 6; if there is a defect in this insulating ring 6 and if arc flashing-over should occur, then there will flow a leakage current of high current strength, which spreads over the surface of the cover and which can result in dangerous displacement of potential.

A fault or leakage current along the path 9 will flow if there are defects in the insulating rings 6 and 7.

According to the invention, arc flashing-over, with its dangerous consequences, can be effectively prevented if the cooling box 3 shown in FIG. 1 is divided into a plurality of cooling box portions, formed e.g. by hollow box members, which are electrically insulated from each other and which are so arranged and constructed that any fault or leakage current path includes at least two electrically insulating positions. This arrangement ensures that, if one insulating position is damaged, there is always a further insulating position available to limit the current flow to a permissible value.

Figure 2:
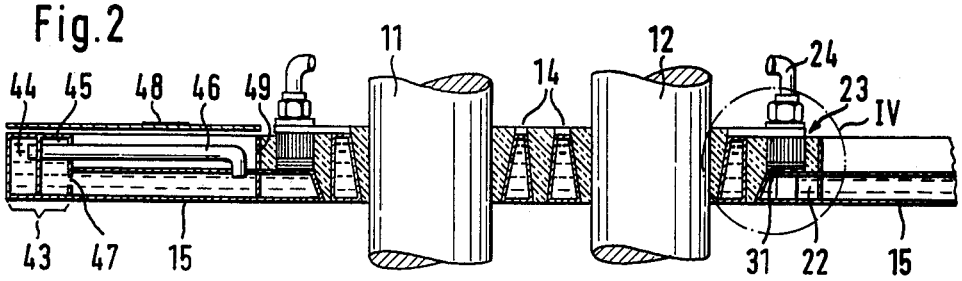
FIG. 2 shows a view of the cover for an arc furnace with three electrodes, in longitudinal section along line II—II in FIG. 3.
Figure 3:
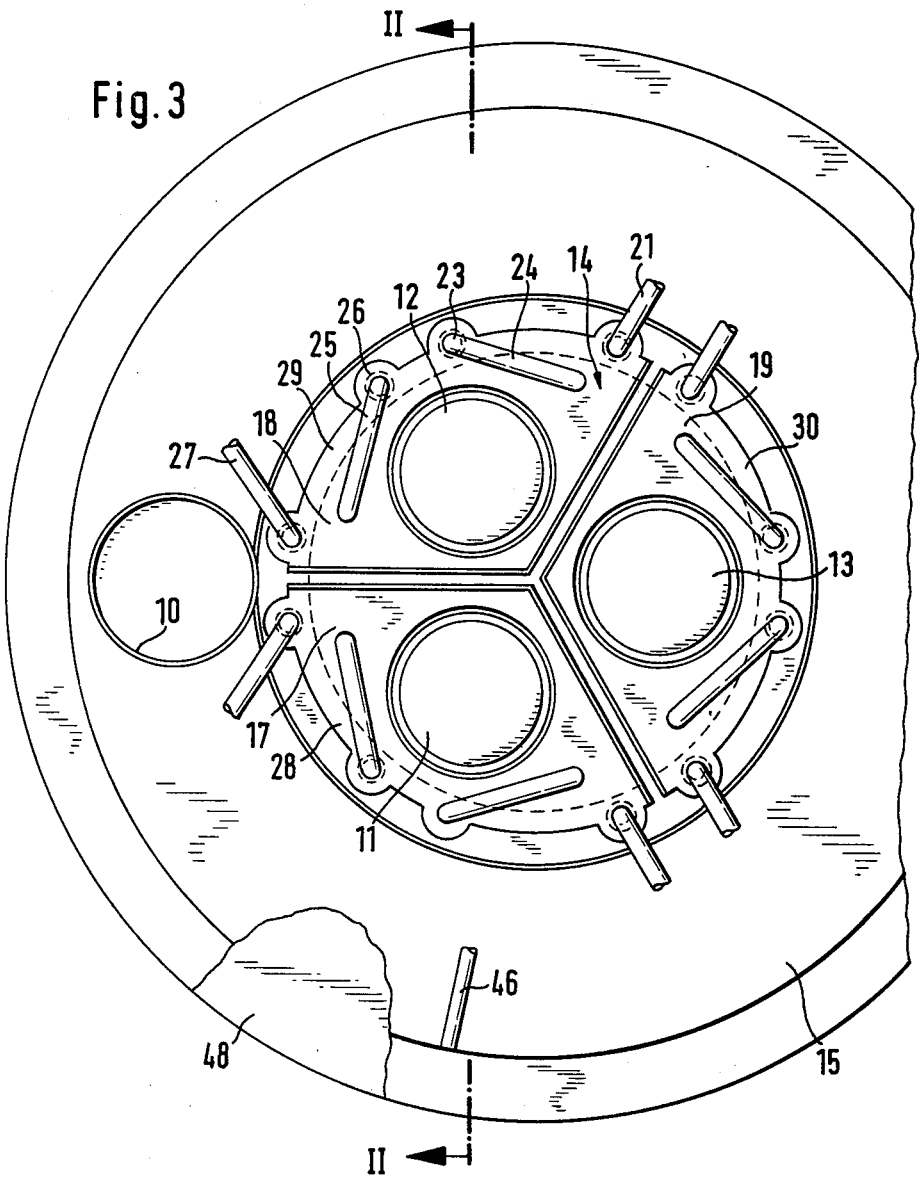
FIG. 3 shows a plan view of the cover of FIG. 2.

Reference is now made to FIGS. 2 and 3 which show a furnace cover including an inner cooling box 14 which surrounds three electrodes 11, 12 and 13, and an outer annular cooling box 15 disposed around the cooling box 14, in the marginal region of the cover. The inner cooling box 14 is electrically insulated from the outer annular cooling box 15. By virtue of this arrangement, an additional insulating position as shown at 16 in dashed line in FIG. 1 is inserted in the possible current path 8, so that the path 8 comprises two insulating positions 6 and 16. In addition, in the illustrated embodiment, the inner cooling box 14 is divided into three sector-shaped box portions or hollow members 17, 18 and 19 which are electrically insulated from each other and which each include a respective through opening for the respective electrode 11, 12 and 13. The electrode openings are positioned in the cover at the corners of an imaginary equilateral triangle. This manner of dividing the cooling box 14 provides a further insulating position as shown at 20 in dashed line in FIG. 1, in the possible current path 9, so that the path 9 comprises three insulating positions 6, 20 and 7. In this embodiment, the joints between the inner cooling box 14 and the outer annular cooling box 15, and between the hollow box portions 17 to 19 of the inner cooling box 14, are each lined with electrically insulating refractory material. FIG. 3 shows, in the outer annular cooling box 15, an opening 10 for removing waste gases and dust, and also shows conduits for the feed and discharge of cooling liquid to and from the hollow box portions 17 to 19. For example, coolant fluid is supplied to the hollow box portion 18 by way of a conduit 21, flows from there into a hollow chamber 22 at the radially inward edge of the outer annular cooling box 15 (see also FIG. 2), is discharged therefrom at position 23, and is introduced into the hollow box portion 18 by way of conduit 24; in the hollow box portion 18, the coolant flows around the electrode 12 and leaves the hollow box portion 18 again by way of conduit 25. At position 26 the conduit 25 communicates with a further hollow chamber in the outer annular cooling box 15; the above-mentioned further hollow chamber corresponds to the previously-mentioned hollow chamber 22 but is divided therefrom. Finally, the coolant leaves the further hollow chamber in the outer annular cooling box 15, by way of conduit 27. The other hollow members or box portions 17 and 19 are supplied with liquid in a similar manner.

As shown in the drawings, the outer edge of the inner cooling box 14, namely the hollow members or box portions 17, 18 and 19, is formed by flanges 28, 29 and 30 respectively, which rest on the radially inward edge of the annular cooling box 15. Each flange is also secured to the radially inward edge of the outer annular cooling box 15, by fixings including electrically insulated tube portions 31 which at the same time provide for the feed of coolant fluid. One such fixing is shown in section on an enlarged scale in FIG. 4, and such fixings are provided at four positions on each hollow member 17 to 19, as shown in FIG. 3; this is sufficient for completely fixing the hollow members 17 to 19 in place.

Figure 4:
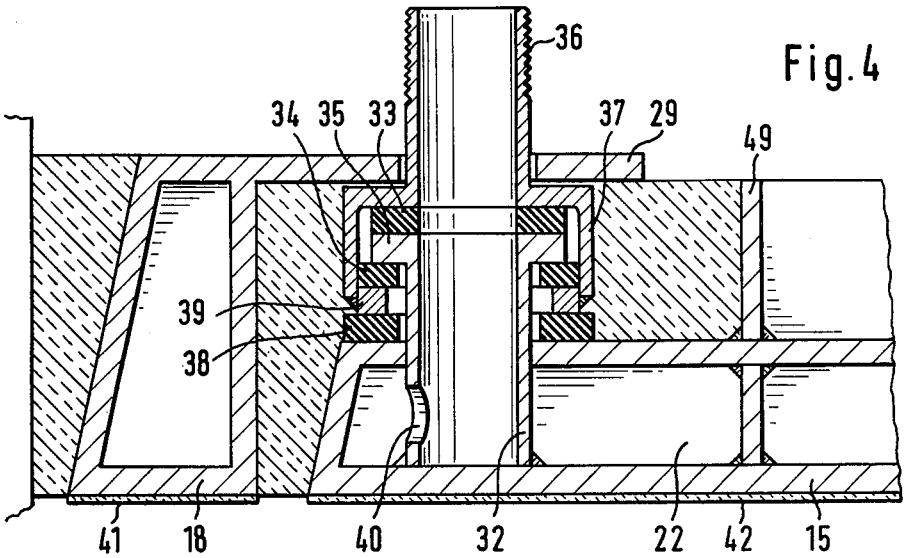
FIG. 4 shows the portion indicated at IV in FIG. 2, on an enlarged scale.

FIG. 4 shows that a fixing position as mentioned above, which also provides for the feed and discharge of coolant, includes a lower tube portion 32 which is secured to the radially inward edge of the outer annular cooling box 15 and which has an outwardly extended annular flange 35 gripped between two insulating rings 33 and 34. A sleeve 37 is mounted on an upper tube portion 36 aligned with the tube portion 32, and fits around and over the annular flange 35. The sleeve 37 has an inwardly extended annular flange 39 which rests on a third insulating ring 38. When the construction shown is assembled, the annular flange 39 is welded or secured in some other way to the body of the sleeve 37, after the two tube portions 32 and 36 have been brought into the positions shown in FIG. 4. The flange 29 of the hollow member 18 rests on the sleeve 37, and is held in position by a nut which is screwed onto the flange but which is shown only in FIG. 2. The respective conduit for the flow of coolant is screwed onto the upper tube portion 36, and the coolant then communicates, by way of an opening 40 in the lower tube portion 32, with the hollow chamber 22 or a similar hollow chamber, in another region of the radially inward edge of the outer cooling box 15.

It will be seen from FIG. 4 that the inner cooling box 14 (portion 18 only is illustrated) has flange 29 which is supported on a flange-like structure, which provides the coolant chamber 22, at the radially inner edge of the outer cooling box 15. This flange on the box 15 is thus cooled by the chamber 22. The flanges 28, 29 and 30 may also be cooled, if required.

Preferably at least a part of the outer surface of the cooling boxes 14, 15 or cooling tubes is covered by a thermal protective layer. Such a thermal protective layer 41 or 42 is shown in FIG. 4, disposed on the underside of the hollow member or box portion 18 and the cooling box 15 respectively. Each layer 41 and 42 is to be fitted to the respective components 18 or 15 so as to adhere firmly thereto. For this purpose, projections (not shown) are provided on the underside of the member 18 and the cooling box 15; such projections secure and simultaneously cool the protective layer 41, 42 which is made of refractory material. The protective layer 41, 42 which is both a thermal protection and at the same time also an electrical insulation, ensures that the insulating positions 16 and 20 cannot be rendered ineffective by an electrical leakage shunt across projecting metal projecting from the charge in the furnace vessel, for example if the underside of the cover should come into contact with projecting metal portions in the furnace charge, when the cover 3 is fitted onto a fully charged furnace.

The cover as shown in FIGS. 2 to 4 has a further particular feature which is described in greater detail hereinafter with reference to FIG. 2.

The outer marginal or peripheral region 43 of the outer cooling box 15 is of greater height than the remainder of the cooling box 15, and is divided in a radial direction into two separate hollow chambers 44 and 45 for the feed and discharge of cooling fluid. The chambers 44 and 45 form annular or ring conduits for the cooling liquid, and serve to supply the whole of the cover 3 with coolant. Tubes 46 and 47 for the supply and discharge of the cooling liquid to and from the individual cooling boxes or hollow members or to and from the respective portions (e.g. 17, 18 and 19) of divided cooling boxes open into the chambers 44 and 45 respectively. The tubes 46, of which only one is shown in FIG. 2 to represent a multiplicity of such tubes, are disposed in the cover 3 itself, in the enlarged marginal region 43. In this way, the tubes 46 can be protected from fouling and thus from the danger of electrical shunt leakages, by a cover member 48 of which only a part is shown in FIGS. 2 and 3. At its radially outer edge, the cover member 48 lies on the marginal portion 43, while at its radially inner edge the cover member 48 rests on an annular web portion 49. This construction makes it possible for the cover 3 to be of a compact form, with the cover including a substantial part of its installation fittings within the cover itself, where such fittings are protected from influences which might impair its insulation. It should also be noted that, in the embodiment illustrated, the outer cooling box 15, which is shown in the form of a closed ring in FIG. 3, may be divided, both in a peripheral direction and in a radial direction, into individual box portions which are supplied separately with cooling liquid. The cooling box 15 may also be provided with means for the positive or forced flow of the cooling fluid, to ensure optimum cooling of the cover 3.

It will be appreciated that, while the above-described cover has at least two cooling portions, each in the form of a cooling box 14 or 15 respectively, the cooling portions could be e.g. in the form of cooling tubes in the respective regions of the cover, the cooling tube regions being electrically insulated and providing at least two insulating positions.

In the above-described liquid-cooled cover, any fault or leakage currents which may occur do not give rise to danger. In addition, the problems which may occur with regard to insulating the cooling boxes or hollow members 17 to 19 from each other, namely that the insulation must be capable of transmitting considerable mechanical forces, while being subjected to a high thermal loading at the same time, without losing its electrical insulation capability, may be solved by the above-described cover in a particularly advantageous manner, insofar as on the one hand the radially outer edge of the inner cooling box 14 or hollow members 17 to 19 is supported on the inner edge of the marginal region of the cover, and on the other hand the mechanical connection between these components is effected by way of the electrically insulated tube portions 31 which at the same time provide for supplying the coolant.

The coolant used in the above-described cover is preferably of a particularly low electrical conductivity value.

What we claim is:

1. A cover for an arc furnace having a plurality of electrodes extending through said cover, said cover having a central area and an outer area surrounding said central area, first cooling means including a first cooling box for cooling substantially said entire central area and surrounding said electrodes, second cooling means including a second cooling box in said outer area, means for passing coolant through said first and second cooling means, means for dividing said first cooling means into a plurality of cooling areas respectively associated with said plurality of electrodes, and means for insulating said cooling areas electrically with respect to each other and with respect to said second cooling means, said second cooling box being an outer annular cooling box around said first cooling box, said outer cooling box having an outer edge portion greater in height than the remainder of the outer cooling box, means dividing said outer cooling box in a radial direction into two separate chambers, said means for passing coolant through said cooling means including passage means into said chambers, and a cover member mounted on the outer cooling box for covering said passage means to thereby prevent contamination thereof.

2. A cover according to claim 1, wherein the outer edge portion of said cooling box of said first cooling means is in the form of a flange.

3. A cover according to claim 1, wherein the inner edge portion of said cooling box of said second cooling means is in the form of a flange.

4. A cover according to claim 1, wherein the inner edge portion and the outer edge portion are each in the form of a flange.

5. A cover according to claim 4, wherein at least the flange at the inner edge portion of the annular cooling box has means for cooling thereof.

6. A cover according to claim 1, comprising mechanical connecting means between said first and second cooling means, said connecting means comprising tube portions which are electrically insulated from each other and which are adapted to feed coolant to said cooling means.

7. A cover according to claim 6, wherein said tube portions comprise a first tube portion secured to one of said cooling means and having an outwardly projecting flange, two insulating rings, means securing said flange between said two rings, and a second tube portion carrying a sleeve which fits over said flange on said first tube portion, a third insulating ring, said sleeve having an inwardly projecting flange which rests on said third insulating ring, said third insulating ring resting on said one cooling means and the other cooling means resting on said sleeve.

8. A cover according to claim 1, comprising a thermal protective layer covering at least a part of the outer surface of said cooling means.

* * * * *

UNITED STATES PATENT AND TRADEMARK OFFICE

CERTIFICATE OF CORRECTION

PATENT NO. : 4,197,422

DATED : April 8, 1980

INVENTOR(S) : GERHARD FUCHS, ET AL.

It is certified that error appears in the above–identified patent and that said Letters Patent are hereby corrected as shown below:

--[73] Assignee: Korf-Stahl AG, Baden-Baden, Fed. Rep. of Germany, a part interest--

Signed and Sealed this

*Twenty-second* Day of *July 1980*

[SEAL]

*Attest:*

SIDNEY A. DIAMOND

*Attesting Officer*

*Commissioner of Patents and Trademarks*